US005175900A

United States Patent [19]

Hadgis

[11] Patent Number: 5,175,900

[45] Date of Patent: Jan. 5, 1993

[54] AUTOMATIC INDEX ROTARY BUFFING APPARATUS

[75] Inventor: John S. Hadgis, Hinckley, Ohio

[73] Assignee: Areway, Inc., Brooklyn, Ohio

[21] Appl. No.: 719,960

[22] Filed: Jun. 24, 1991

[51] Int. Cl.[5] ..... B24B 29/02; A46B 13/02; B24D 13/08

[52] U.S. Cl. ..... 15/97.1; 15/88.3; 15/230.14; 51/4; 51/76 R; 51/106 R; 29/33 A

[58] Field of Search ..... 15/4, 97.1, 88.3, 230.14, 15/230.15, 88.2, 88.4, 102; 51/4, 76 R, 90, 103 R, 103 C, 104, 105 R, 106 R, 108 R, 237 R, 328; 29/33 A, DIG. 7

[56] References Cited

U.S. PATENT DOCUMENTS

| | | | |
|---|---|---|---|
| 2,731,372 | 1/1956 | Kirsch | 15/88.3 |
| 2,803,096 | 8/1957 | Mockiewicz | 15/230.14 |
| 3,064,290 | 11/1962 | Bleke | 15/88.3 |
| 3,336,621 | 8/1967 | Jeske | 15/230.14 |
| 3,441,968 | 5/1969 | Kramen | 15/97.1 |
| 4,611,362 | 9/1986 | Sinclair | 15/230.15 |

FOREIGN PATENT DOCUMENTS

| | | | |
|---|---|---|---|
| 148997 | 11/1952 | Australia | 15/230.14 |

*Primary Examiner*—Edward L. Roberts
*Attorney, Agent, or Firm*—Renner, Otto, Boisselle & Sklar

[57] ABSTRACT

Automatic index rotary buffing apparatus includes a plurality of buffing stations at which buffing heads are rotated relative to a workpiece having recesses in a face thereof for buffing the workpiece at each buffing station. The buffing heads at the last two buffing stations comprise bias pleated cotton buffs which, at the next to last buffing station, are rotated against the rotation of the workpiece to clean out one side of the recesses in the workpiece, and at the last buffing station, are rotated with the rotation of the workpiece to clean out the other sides of the recesses and to color buff the workpiece.

18 Claims, 2 Drawing Sheets

AUTOMATIC INDEX ROTARY BUFFING APPARATUS

BACKGROUND OF THE INVENTION

This invention generally relates to an automatic index rotary buffing apparatus for buffing large volumes of heavy duty components such as aluminum wheels for trucks and automobiles in a relatively short period of time.

Automatic indexing rotary buffing apparatus or machines are generally known. Typically, an index table having a number of work stations at which rotary buffing heads are placed have been employed. The buffing heads are designed for cut buffing different surfaces (faces) of the workpieces including the removal of sharp edges around mounting holes and/or decorative windows or pockets in the workpieces.

There is a need, however, for an automatic index rotary buffing apparatus that will not only cut buff the workpieces, but will clean out the windows or pockets in the workpieces of material that has been deposited thereon as a result of cut buffing operations performed as the workpieces are indexed from one station to another. Also, there is a need for an automatic index rotary buffing apparatus that will color buff the workpieces to a higher or brighter finish than is possible during cut buffing operations.

SUMMARY OF THE INVENTION

In accordance with one aspect of the present invention, a rotary index buffing apparatus is provided which includes, in addition to the usual work stations for cut buffing the workpieces, at least two additional work stations for cleaning out any decorative windows or pockets and the like in the workpieces of material that has been deposited therein as a result of the cut buffing operations.

In accordance with another aspect of the invention, the buffing heads that are used to clean out the decorative windows or pockets at the additional work stations may also be used to color buff the workpieces to a higher or brighter finish.

These and other aspects of the present invention may be achieved by providing an automatic index rotary buffing apparatus having a plurality of work stations each of which rotatably supports a workpiece and includes rotatable buffing heads for buffing a workpiece at each work station. The type, number and hardness of the buffs at various work stations may be varied for buffing different surfaces or faces of the workpieces. Cut buffing operations are usually performed using treated bias type sisal buffs in conjunction with a sharp or fast cut buffing compound to smooth the surfaces and remove sharp edges from around holes and decorative windows or pockets in the workpieces. Buffs at different work stations may also be driven in different directions to remove sharp edges from opposite sides of the holes and decorative windows or pockets in the workpieces.

At the last two work stations different types of buffs made of bias pleated cotton are provided. These buffs are driven at a slower speed, in the range of 300 to 400 rpm, than at the other work stations. Also, the buffs at the next to last station are rotated against the workpieces for cleaning one side of the windows or pockets and the buffs at the last work station are rotated with the workpieces to clean the other side of the windows or pockets and to color buff the workpieces.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
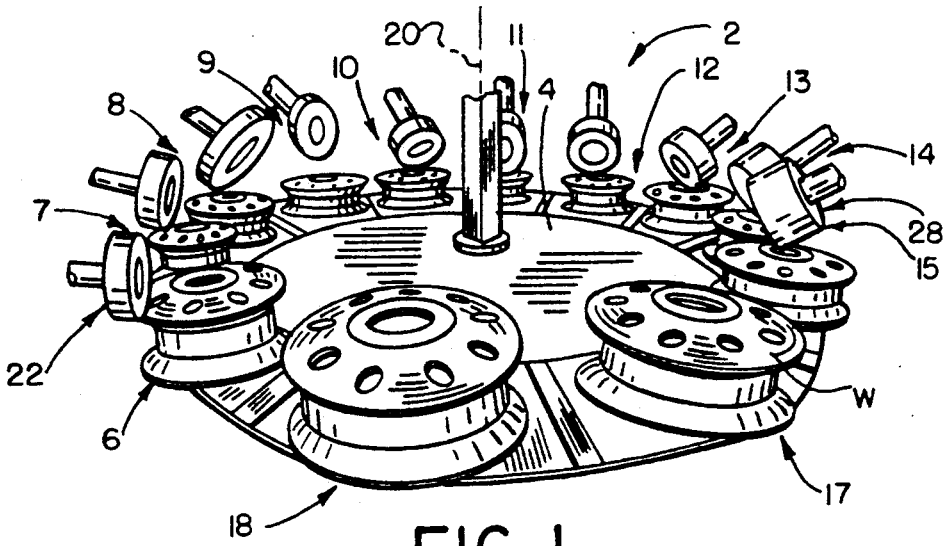
FIG. 1 is a schematic fragmentary perspective view of a preferred form of automatic index rotary buffing apparatus in accordance with this invention.

Referring now in detail to the drawing, and initially to FIG. 1, there is shown an automatic indexing buffing apparatus or machine 2 in accordance with this invention including a rotatable table 4 adapted to support a number of workpieces W for indexing movement between a plurality of circumferentially spaced work stations 6–15 at which various buffing operations may be performed, and one or more loading/unloading stations 17, 18 for loading and unloading the workpieces to begin and end the buffing operations. The main table 4 generally rotates about a center axis 20 and is driven by conventional means which may include chain drives mounted under the table.

In the embodiment illustrated herein, ten individual work stations 6–15 and two individual loading/unloading stations 17, 18 are shown. However, it will be appreciated that a greater or lesser number of work stations and/or loading/unloading stations may be provided depending on the number and type of buffing operations to be performed by the buffing machine 2.

The workpieces W for which the machine 2 is particularly adapted ar heavy duty components such as aluminum wheels for trucks or automobiles. The machine 2 is designed for buffing large volumes of such wheels W in a relatively short period of time.

At the first eight work stations 6–13 different types and numbers of buffing heads 22 having different hardnesses for cut buffing different surfaces or faces of the workpieces W may be provided as the workpieces are successively indexed from one work station to another. In the illustration of FIG. 1 this indexing is in a clockwise direction but could be in a counterclockwise direction if desired. The cut buffing operations are normally performed using treated bias type sisal buffing heads in conjunction with a sharp or fast cutting buffing compound to smooth the workpiece surfaces and remove sharp edges from around holes and decorative windows or pockets in the workpieces. During the buffing operation at each work station 6–13, the individual workpieces W may all be driven in the same direction and the buffing heads 22 at different work stations driven in the same or different directions to remove sharp edges from the sides of various holes and decorative windows or pockets in the workpieces.

Figure 2:
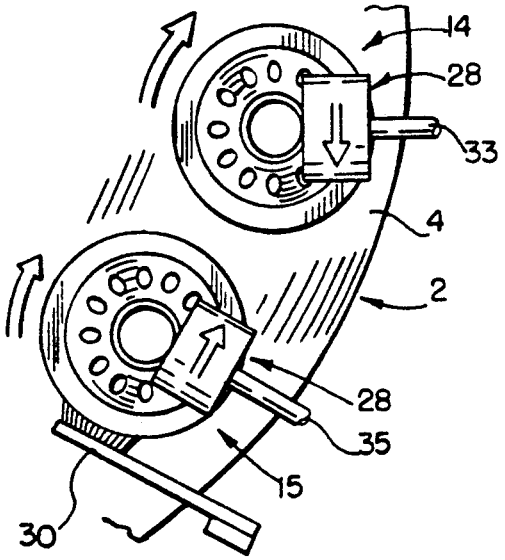
FIG. 2 is an enlarged schematic plan view of the last two buffing stations of FIG. 1.

At the last two work stations 14 and 15 a different type of buffing head 28 is employed than at the previous work stations 6–13. Buffing heads 28 desirably include a plurality of bias pleated cotton buffs 29 having the desired number of plies. Sixteen ply bias pleated cotton buffs 29 having a thread count of 60/62 have been found suitable for cleaning out decorative windows or pockets in large wheels and for color buffing the wheels to a relatively high or bright finish. It will also be seen in FIG. 2 that a brush 30 may be mounted at the last work station 15 for contact with the sides of the workpiece W to clean the sides during rotation at the last work station.

Figure 4:
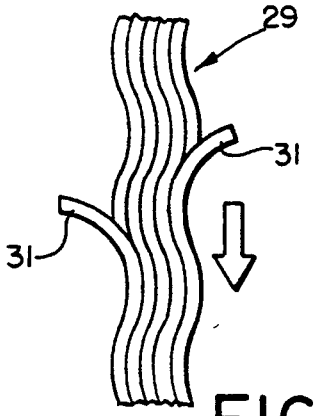
FIG. 4 is an enlarged fragmentary edge view of one of the individual buffs of FIG. 3 showing the tails on opposite sides thereof.

A portion of one such pleated buff 29 is illustrated in FIG. 4 as having tails 31. This type of buff should always be rotated in a direction away from the tails so that the tails are held against the buff by air turbulence to prevent them from flaring out and being grabbed by the workpiece W which could potentially tear the workpiece from the fixture on the index table 4 or tear the cloth from the buff.

Figure 3:
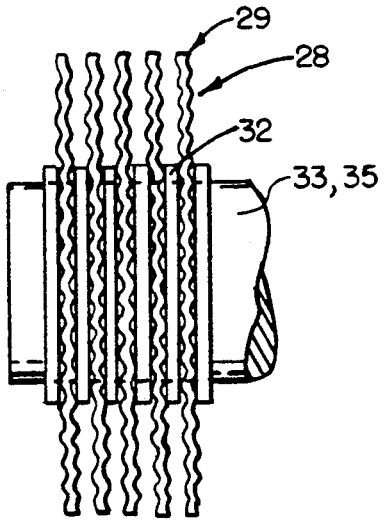
FIG. 3 is an enlarged top plan view of one of the buffing heads of FIG. 2 showing the spacing between individual buffs.

Moreover, as schematically illustrated in FIG. 3, the individual buffs 29 which make up the buffing heads 28 at each of the work stations 14 and 15 are separated by spacers 32 axially spaced and mounted for rotation on a spindle or arbor 33, 35. The spacers 32 allow the buff material to spread out and enter the windows or pockets 38 (FIGS. 5–10) of the workpiece W.

The number of individual buffs 29 and spacers 32 in a given buffing head 28 may vary depending on the radius of the workpiece W. If, for instance, a workpiece has an effective radius of four inches, then five buffs 29 each approximately one-half inch wide, with four one-half inch spacers 32 therebetween can be used for buffing the entire radius of the workpiece during relative rotation therebetween. The actual spacing, number and type of the individual buffs 29 is a function of the workpiece radius and depth of the workpiece windows or pockets being cleaned thereby.

In performing the buffing operations, workpieces W are placed on the loading/unloading stations 17,18 and appropriately secured thereto for indexing movement from one work station to another as the indexing table 4 is turned so as to present the workpieces to various buffing heads 22, 28 at the various work stations 6–15. Suitable means such as a motor driven chain positioned under rotatable table 4 for engaging appropriate sprockets are provided for rotating the workpieces at each work station.

Referring now to FIGS. 5–10, it will be appreciated that each workpiece W is rotated about its axis. This rotation may be in the same direction, for example, counterclockwise, at all of the work stations.

Figure 5:
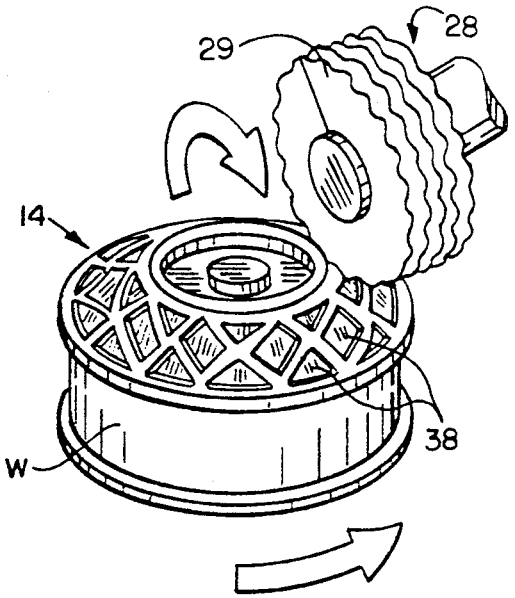
FIG. 5 is an enlarged fragmentary perspective view illustrating relative buff and workpiece rotation at the next to last work station.
Figure 6:
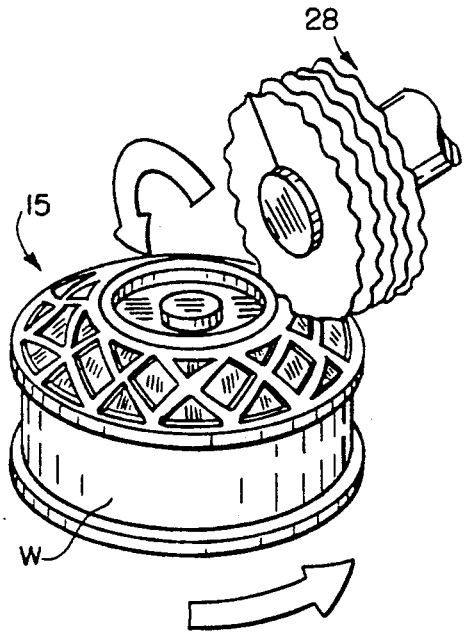
FIG. 6 is an enlarged fragmentary perspective view illustrating relative buff and workpiece rotation at the last work station.
Figure 7:
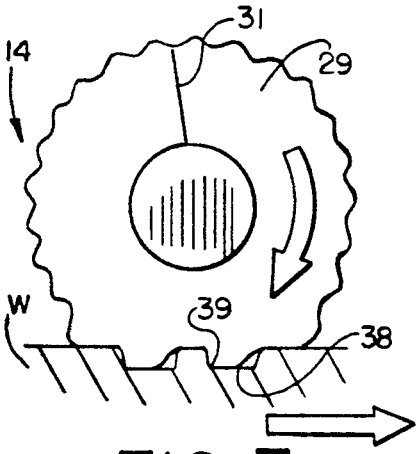
FIG. 7 is a further enlarged fragmentary cross sectional view through the workpiece of FIG. 5 adjacent the left end of the buffing head illustrating buff penetration into recesses in a workpiece to clean one side of the recesses.
Figure 8:
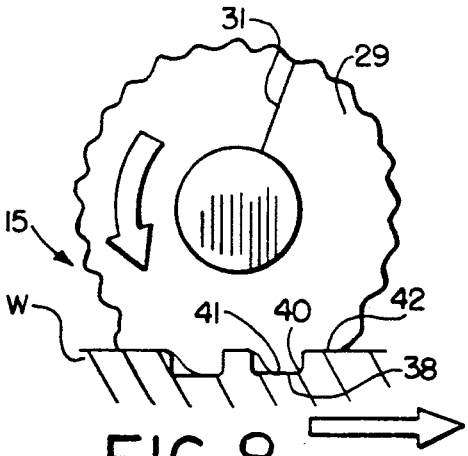
FIG. 8 is a further enlarged fragmentary cross sectional view through the workpiece of FIG. 6 taken adjacent the left end of the buffing head illustrating buff penetration into recesses in a workpiece to clean the other side of the recesses.
Figure 9:
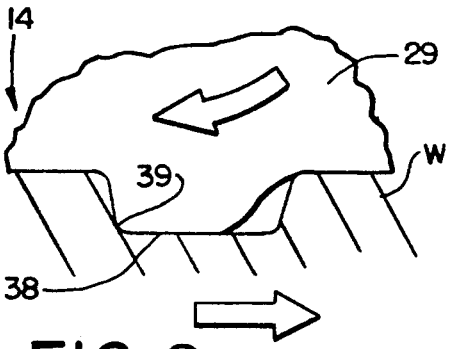
FIG. 9 is a still further enlarged fragmentary view of the workpiece and buffing head of FIG. 7.
Figure 10:
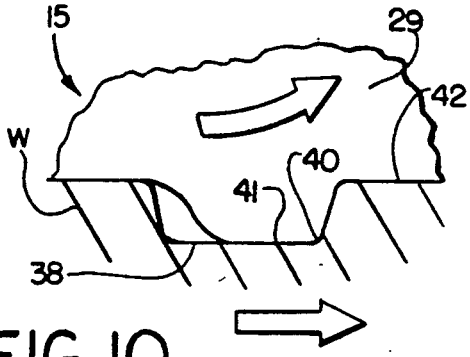
FIG. 10 is a still further enlarged fragmentary view of the workpiece and buffing head shown in FIG. 8.

When a workpiece W is indexed from the prior work stations 6–13 to the second to last work station 14 it will be seen, as is illustrated in FIGS. 5, 7 and 9, the direction of rotation of the buffing head 28 is against the normal direction of rotation of the workpiece W (i.e. clockwise when the workpiece is rotating counterclockwise) in order that the individual buffs 29 will enter the windows or pockets 38 and clean out one side of the windows (i.e. the left side 39 as seen in FIGS. 7 and 9). Thereafter, the workpiece W is indexed to the last work station 15 where the buffing head 29 rotates with the normal direction of rotation of the workpiece W (i.e. in the counterclockwise direction as viewed in FIGS. 6, 8 and 10) not only to clean out the other side of the windows (i.e. the right side 43 as seen in FIGS. 8 and 10), but also to color buff the bottoms 41 of the windows or pockets and end face 42 of the workpiece W engaged thereby to a relatively high or bright finish. Preferably, the buffing heads 28 at the last two work stations 14 and 15 rotate at a slower speed than the other buffing heads 22, in the range of 300 to 400 rpm, which allows the buff material to move freely into and out of the windows or pockets 38 to clean out the material deposited therein during the buffing operations at the other work stations.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the following claims.

What is claimed is:

1. Automatic index rotary buffing apparatus comprising a plurality of buffing stations each including means for rotating a workpiece having recesses in a face thereof, and rotatable buffing means for buffing the workpiece at each buffing station, the buffing means at the next to last buffing station being driven against the rotation of the workpiece for cleaning out one side of the recesses, and the buffing means at the last buffing station being driven with the rotation of the workpiece at the last buffing station for cleaning out the other side of the recesses and for color buffing the workpiece.

2. The buffing apparatus of claim 1 wherein the buffing means at the last and next to last buffing stations include buffs made of cotton.

3. The buffing apparatus of claim 2 wherein said buffs comprise bias pleated cotton buffs.

4. The apparatus of claim 3 wherein said buffs have a 60/62 thread count.

5. The buffing apparatus of claim 4 wherein said buffing means at the last two buffing stations include untreated, multi-ply bias cut cotton buffs.

6. The buffing apparatus of claim 5 wherein said buffs at said last two stations include sixteen plies.

7. The apparatus of claim 2 wherein the buffing means at the last and next to last buffing stations include a plurality of said buffs axially spaced on an arbor by spacer means between said buffs.

8. The buffing apparatus of claim 1 further comprising a plurality of other buffing stations than the last and next to last buffing stations, said other buffing stations including buffs having different hardnesses than the buffs at the last and next to last buffing stations for cut buffing different surfaces of the workpiece.

9. The buffing apparatus of claim 1 further comprising a plurality of other buffing stations than the last and next to last buffing stations, said other buffing stations including buffing means having different types and numbers of buffs having different hardnesses than the buffs at the last and next to last buffing stations for cut buffing different surfaces of the workpiece.

10. The buffing apparatus of claim 2 further comprising a plurality of other buffing stations than the last and next to last buffing stations, said other buffing stations including buffing means which are driven in different directions relative to the workpiece to smooth different workpiece surfaces and remove sharp edges from around the recesses in the workpiece.

11. The buffing apparatus of claim 2 further comprising a plurality of other buffing stations than the last and next to last buffing stations, said other buffing stations including buffing means having buffs that are made of a sisal-type material.

12. Automatic index rotary buffing apparatus comprising a plurality of buffing stations for supporting a workpiece having recesses in a face thereof, and buffing means at each of the buffing stations rotatable relative to the workpiece for buffing the workpiece at each buffing station, the buffing means at least at the last two buffing stations including buffs made of cotton, said buffs at one of the last two buff stations being rotatable in one direction relative to the workpiece to clean out one side of the recesses in the workpiece, and the buffs at the other of the last two buff stations being rotatable in the opposite direction relative to the workpiece to clean out the other side of the recesses in the workpiece.

13. The buffing apparatus of claim 12 wherein the workpiece at the last two buffing stations is rotated in one direction, the buffs at the next to last buffing station are rotated against the rotation of the workpiece to clean out one side of the recesses, and the buffs at the last buffing station are rotated with the rotation of the workpiece to clean out the other side of the recesses and to color buff the workpiece.

14. The buffing apparatus of claim 12 wherein the buffs at the last two buffing stations comprise bias pleated cotton buffs.

15. The buffing apparatus of claim 14 wherein the buffs at the last two buffing stations have a 60/62 thread count.

16. The apparatus of claim 14 wherein the buffs at the last two buffing stations are rotated at approximately 300 to 400 rpm to clean out the recesses.

17. The buffing apparatus of claim 12 wherein a plurality of bias pleated cotton buffs are provided at the last two buffing stations, said buffs being axially spaced on an arbor by spacer means between said buffs.

18. Automatic index rotary buffing apparatus comprising at least three buffing stations each including means for rotating a workpiece having recesses in a face thereof, and rotatable buffing means for buffing the workpiece at each buffing station, the buffing means at the next to last buffing station being driven against the rotation of the workpiece for cleaning out one side of the recesses, the buffing means at the last buffing station being driven with the rotation of the workpiece at the last buffing station for cleaning out the other side of the recesses and for color buffing the workpiece, and the buffing means at another buffing station than the last and second to last buffing stations having a different hardness than the buffing means at the last and next to last buffing stations for cut buffing the workpiece.

* * * * *